US010964470B2

(12) United States Patent
Hasu et al.

(10) Patent No.: US 10,964,470 B2
(45) Date of Patent: Mar. 30, 2021

(54) COIL AND METHOD FOR FORMING A COIL

(71) Applicant: Tamura Corporation, Tokyo (JP)

(72) Inventors: Masatoshi Hasu, Sakado (JP); Kaoru Hattori, Sakado (JP); Ryo Nakatsu, Sakado (JP); Sei Urano, Sakado (JP); Kensuke Maeno, Sakado (JP)

(73) Assignee: TAMURA CORPORATION, Tokyo (JP)

( * ) Notice: Subject to any disclaimer, the term of this patent is extended or adjusted under 35 U.S.C. 154(b) by 37 days.

(21) Appl. No.: 16/553,873

(22) Filed: Aug. 28, 2019

(65) Prior Publication Data

US 2019/0385784 A1 Dec. 19, 2019

Related U.S. Application Data

(60) Continuation of application No. 13/315,067, filed on Dec. 8, 2011, now Pat. No. 10,403,430, which is a (Continued)

(30) Foreign Application Priority Data

May 11, 2006 (JP) ..... 2006-133041
Jan. 30, 2007 (JP) ..... 2007-018828

(51) Int. Cl.
*H01F 27/28* (2006.01)
*H01F 41/061* (2016.01)
(Continued)

(52) U.S. Cl.
CPC ..... *H01F 27/2847* (2013.01); *H01F 41/061* (2016.01); *H01F 3/14* (2013.01);
(Continued)

(58) Field of Classification Search
CPC ..... H01F 27/2847; H01F 41/061; H01F 3/14; H01F 27/022; H01F 27/325;
(Continued)

(56) References Cited

U.S. PATENT DOCUMENTS 5,805,042 A * 9/1998 Chastain ..... H01F 17/04 333/131
6,657,529 B1 12/2003 Albach
(Continued)

FOREIGN PATENT DOCUMENTS

JP 06-045148 A 2/1994
JP H 10-172852 A 6/1998
(Continued)

OTHER PUBLICATIONS

United States Notice of Allowance dated Apr. 22, 2019 in U.S. Appl. No. 13/315,067.
(Continued)

*Primary Examiner* — Mang Tin Bik Lian
(74) *Attorney, Agent, or Firm* — McGinn I. P. Law Group, PLLC.

(57) ABSTRACT

A coil includes first and second coil elements both of which are formed by feeding one piece of a rectangular wire rod by a predetermined amount and winding rectangularly in an edgewise manner using winding heads, the first and second coil elements being wound in opposite directions from each other. A winding terminating end point of the first coil element is bent approximately 90 degrees in a direction opposite to a winding direction of the first coil element, and is connected to a winding terminating end point of the second coil element in a same flat plane. The second coil element includes an offset portion of the rectangular wire rod that is offset in a plan view from a side of the second coil element.

15 Claims, 10 Drawing Sheets

Related U.S. Application Data division of application No. 12/227,181, filed as application No. PCT/JP2007/000507 on May 11, 2007, now Pat. No. 8,091,211.

(51) Int. Cl.
*H01F 3/14* (2006.01)
*H01F 27/02* (2006.01)
*H01F 27/32* (2006.01)

(52) U.S. Cl.
CPC ..... *H01F 27/022* (2013.01); *H01F 27/325* (2013.01); *Y10T 29/4902* (2015.01); *Y10T 29/49069* (2015.01); *Y10T 29/49071* (2015.01); *Y10T 29/49073* (2015.01)

(58) Field of Classification Search
CPC ..... Y10T 29/4902; Y10T 29/49071; Y10T 29/49069; Y10T 29/49073
See application file for complete search history.

(56) References Cited

U.S. PATENT DOCUMENTS

| | | | | |
|---|---|---|---|---|
| 7,082,674 | B2 | 8/2006 | Mori et al. | |
| 7,161,458 | B2 | 1/2007 | Jang et al. | |
| 7,164,331 | B2 | 1/2007 | Reddy | |
| 7,315,231 | B2 * | 1/2008 | DuVal | H01F 29/02 336/107 |
| 7,356,911 | B2 | 4/2008 | Harada et al. | |
| 7,427,909 | B2 | 9/2008 | Ono et al. | |
| 8,284,010 | B2 | 10/2012 | Tsuji et al. | |
| 2005/0012581 | A1 * | 1/2005 | Ono | H01F 3/08 336/90 |

FOREIGN PATENT DOCUMENTS

| | | | | |
|---|---|---|---|---|
| JP | 2000-195725 | A | | 7/2000 |
| JP | 2000195725 | A | * | 7/2000 |
| JP | 2003-124039 | A | | 4/2003 |
| JP | 2003-133155 | A | | 5/2003 |
| JP | 2005-57113 | A | | 3/2005 |
| JP | 2005057113 | A | * | 3/2005 |
| JP | 2005-93852 | A | | 4/2005 |
| JP | 3737461 | | | 11/2005 |
| WO | WO 2006/016554 | A1 | | 2/2006 |

OTHER PUBLICATIONS

United States Office Action dated Jan. 23, 2019 in U.S. Appl. No. 13/315,067.
United States Office Action dated Aug. 29, 2018 in U.S. Appl. No. 13/315,067.
United States Office Action dated Jan. 21, 2015 in U.S. Appl. No. 13/315,067.
United States Office Action dated Apr. 2, 2014 in U.S. Appl. No. 13/315,967.
United States Office Action dated Sep. 13, 2013 in U.S. Appl. No. 13/315,067.
United States Office Action dated Mar. 22, 2013 in U.S. Appl. No. 13/315,067.
German Office Action, dated Nov. 25, 2019, in German Application No. 11 2007 001 155.6 and English Translation thereof.

* cited by examiner

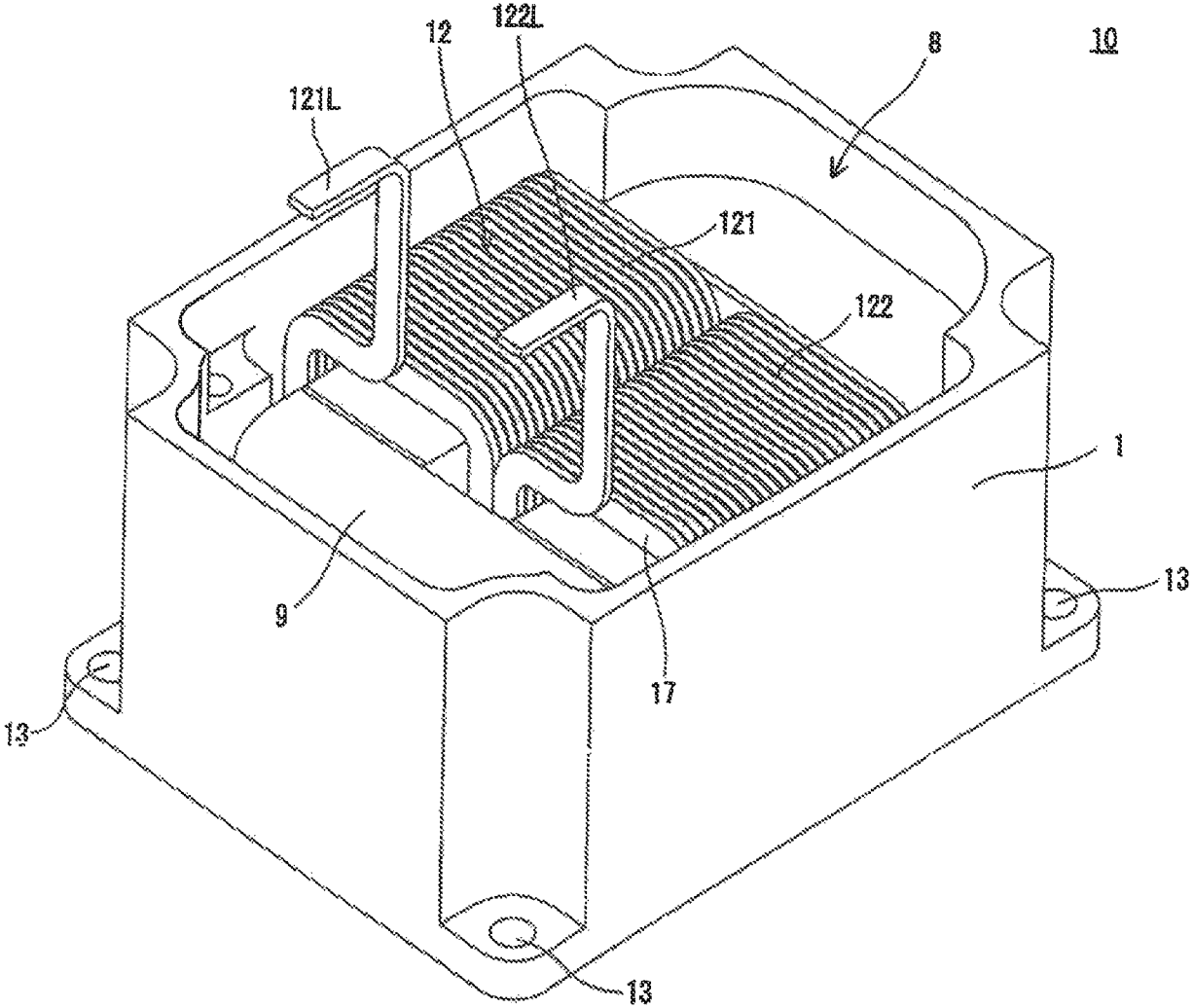
[Fig. 1]

[FIG.2]
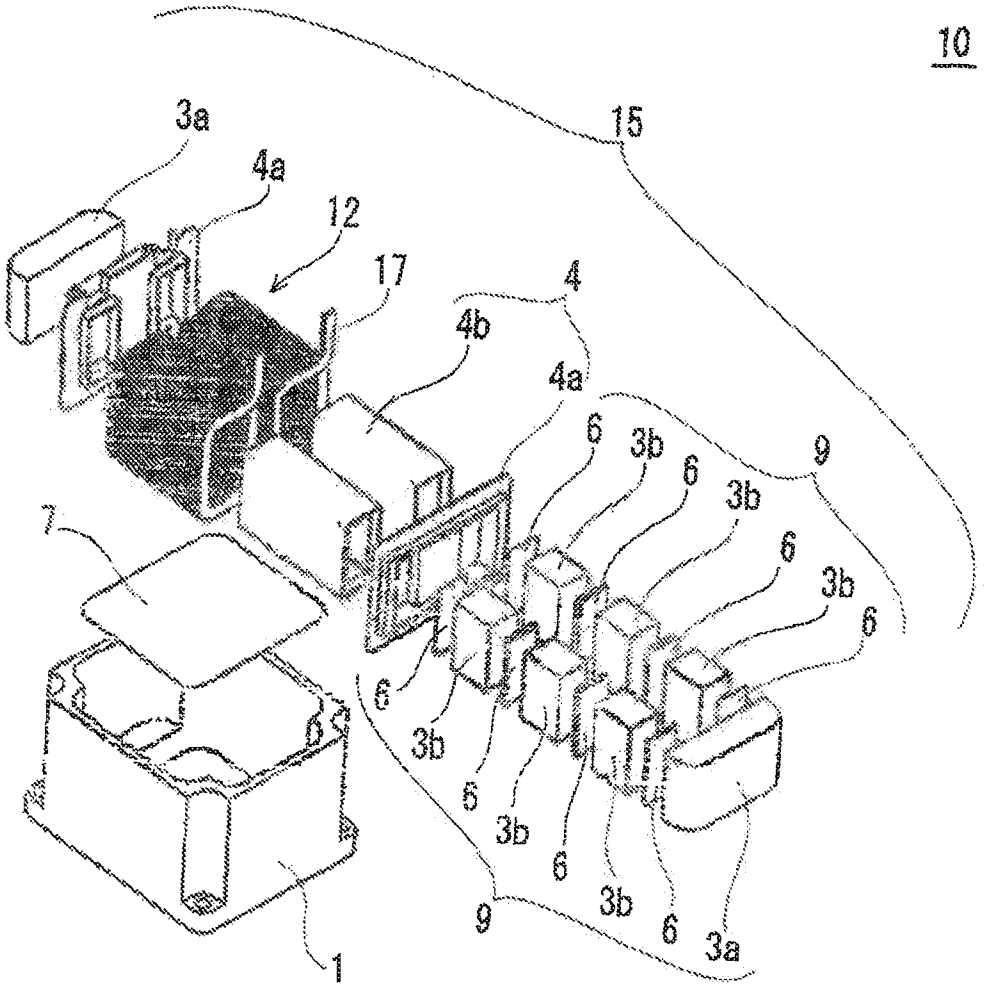

[FIG.3]
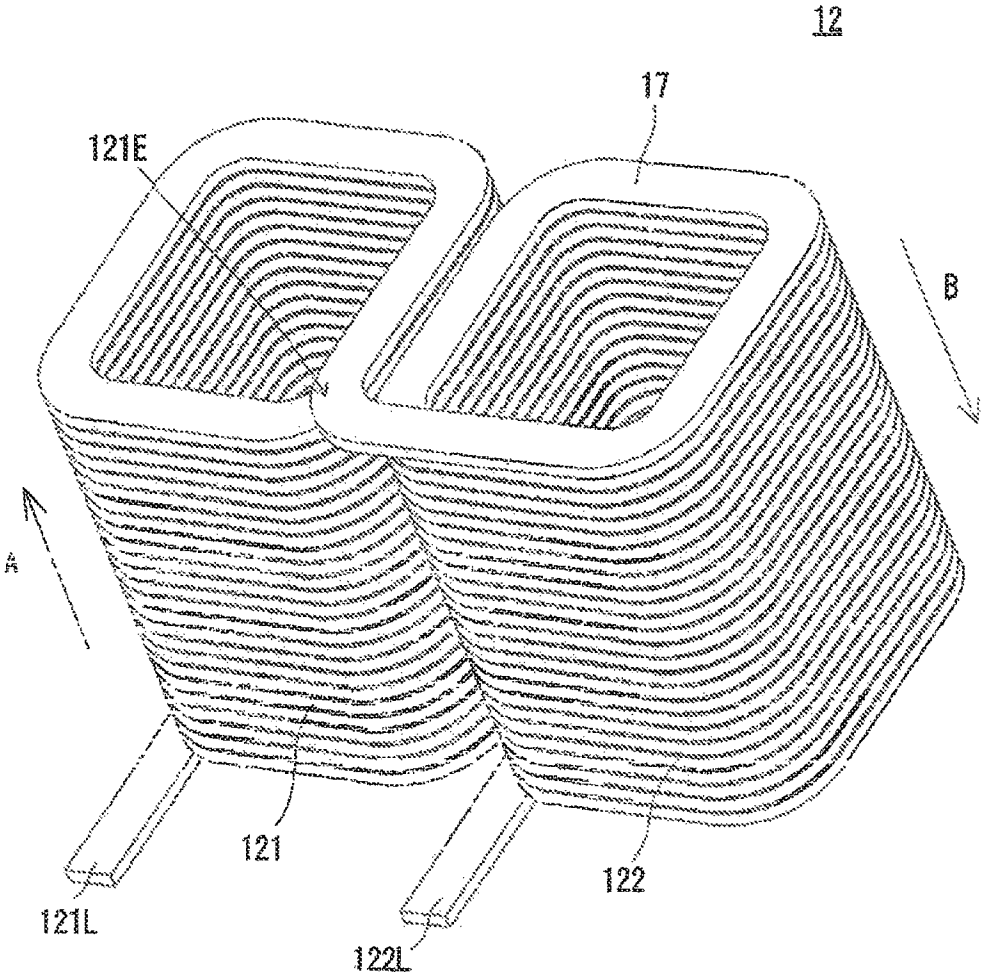

[FIG. 4A]
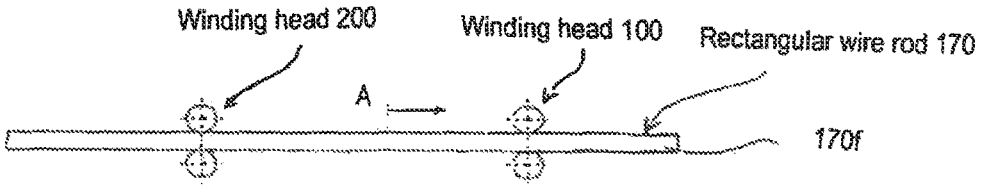
[FIG. 4B]
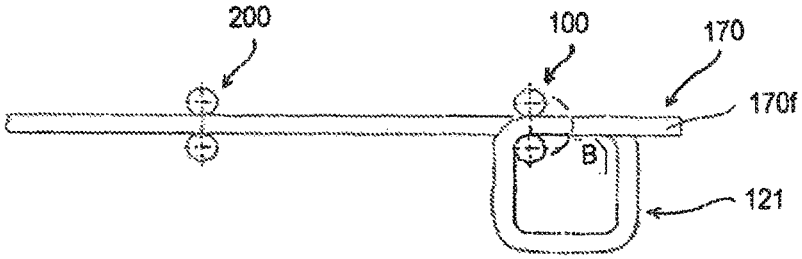
[FIG. 4C]
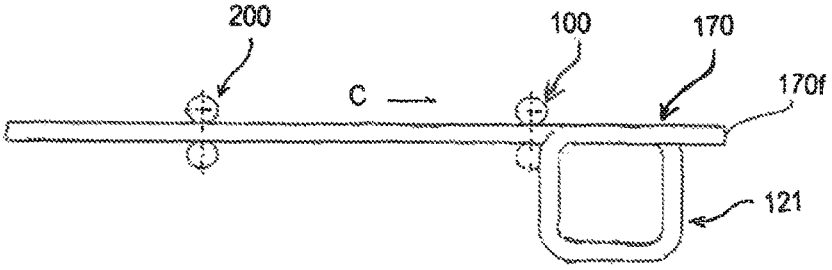
[FIG. 4D]
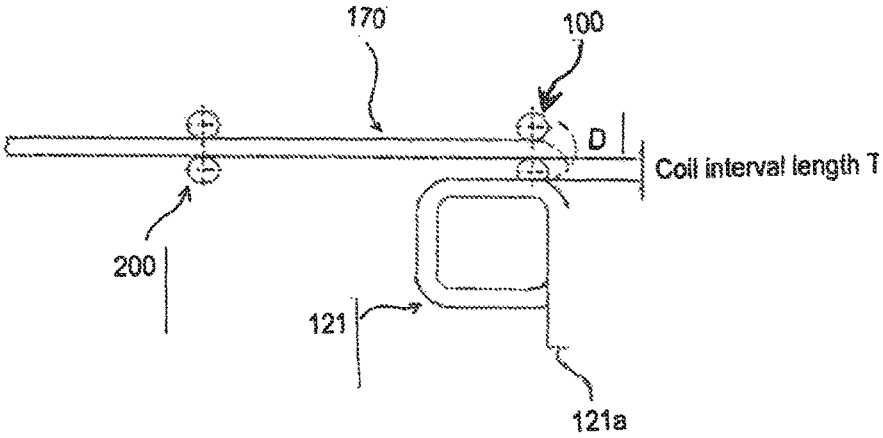

[FIG. 5A]
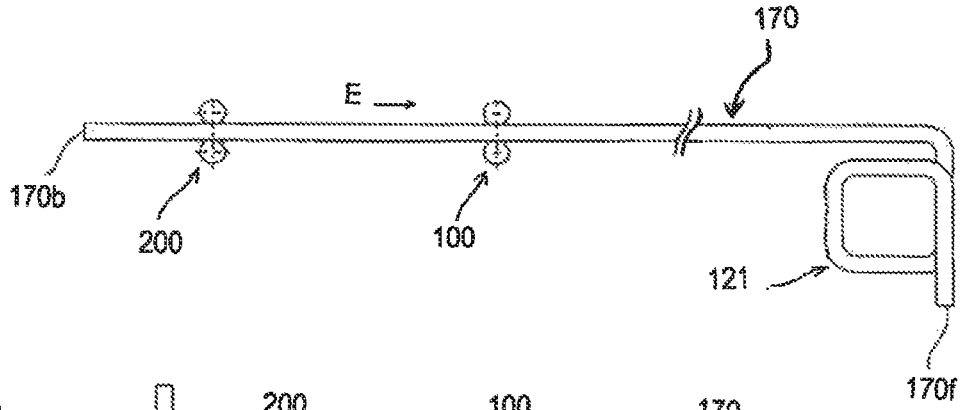
[FIG. 5B]
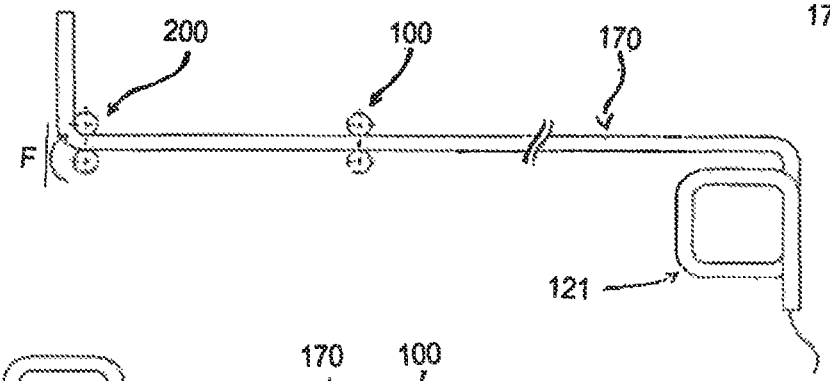
[FIG. 5C]
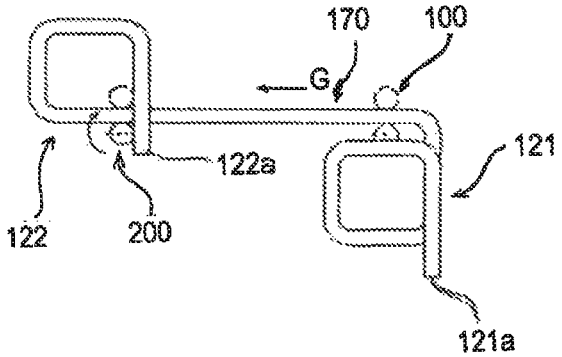

[FIG. 6A]
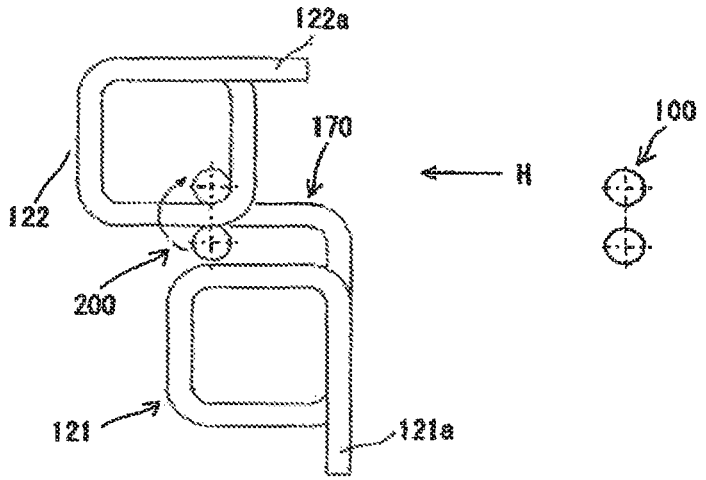
[FIG. 6B]
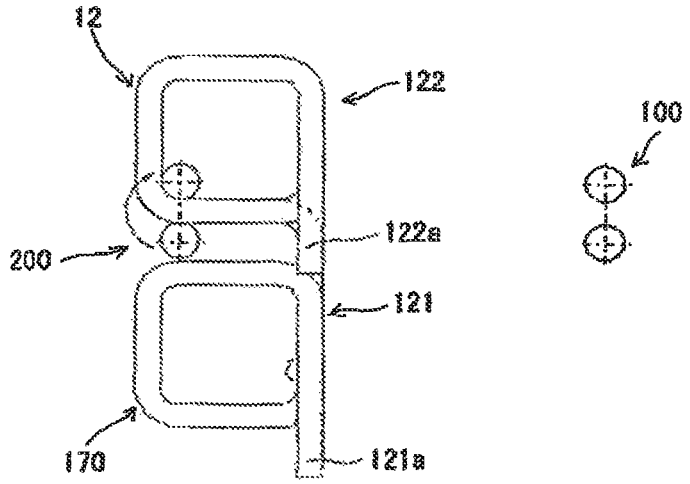

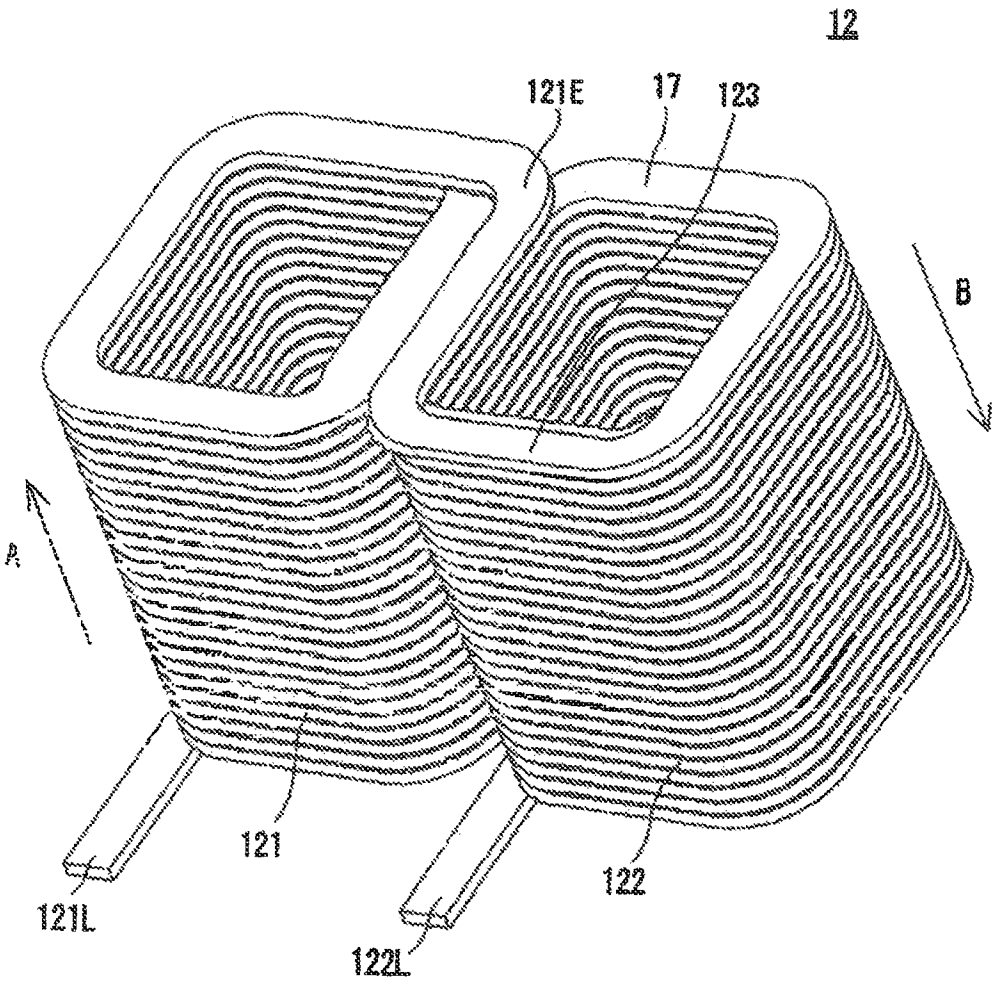
[Fig. 7]

[FIG. 8A]
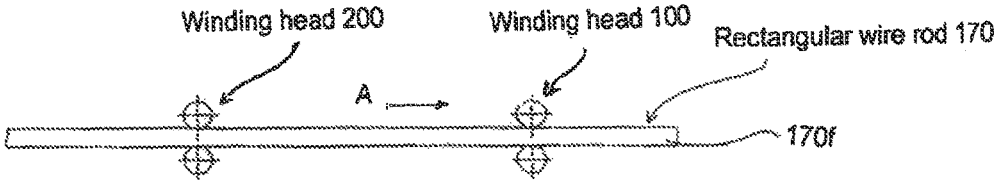
[FIG. 8B]
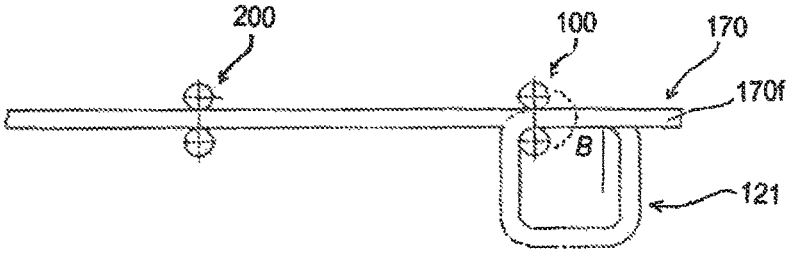
[FIG. 8C]
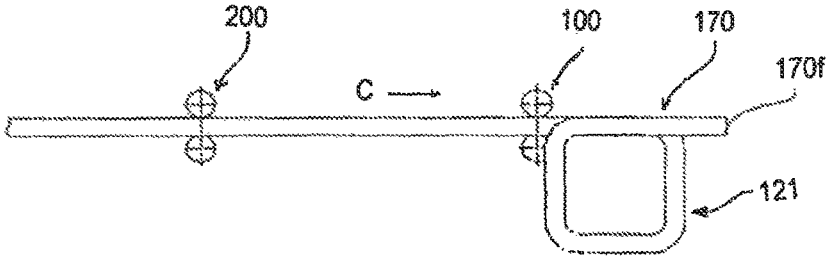
[FIG. 8D]
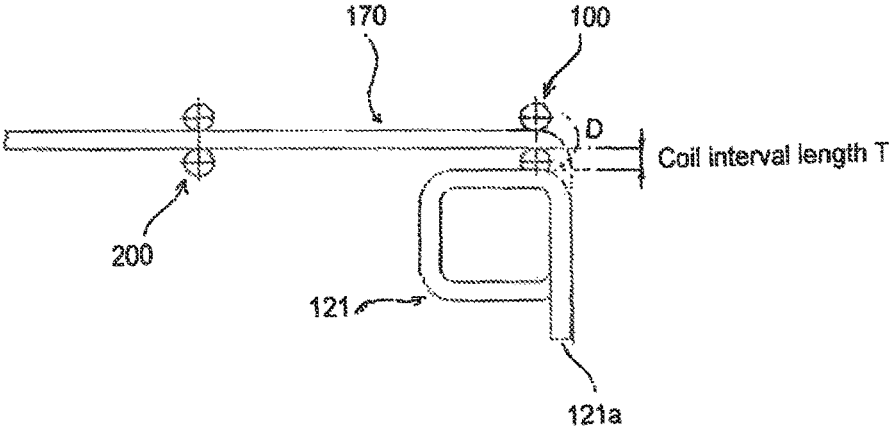

[FIG. 9A]
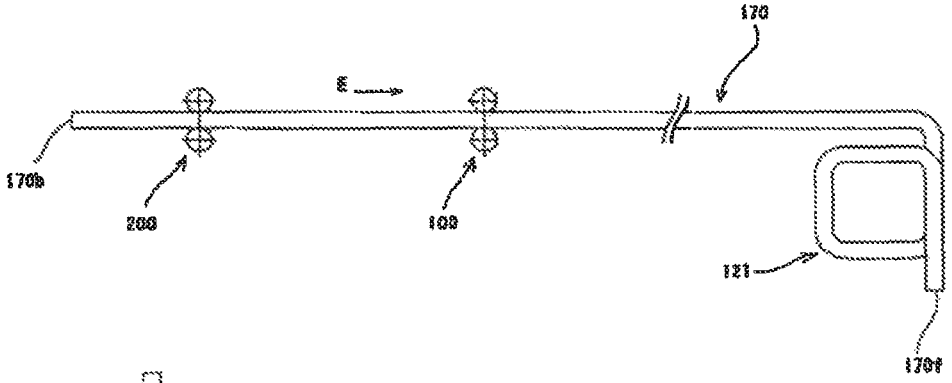
[FIG. 9B]
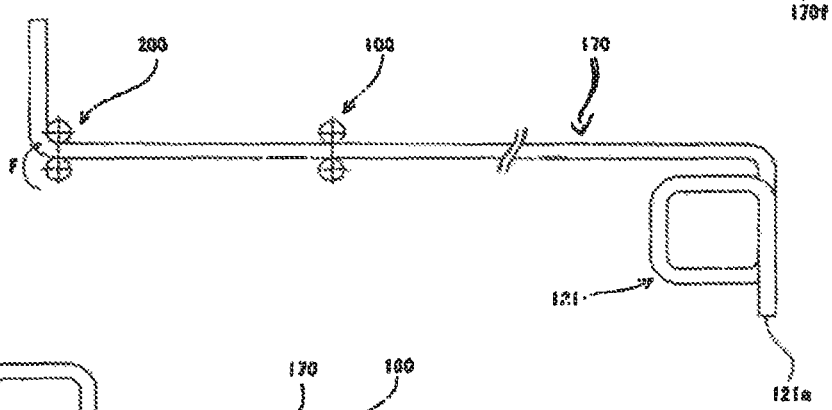
[FIG. 9C]
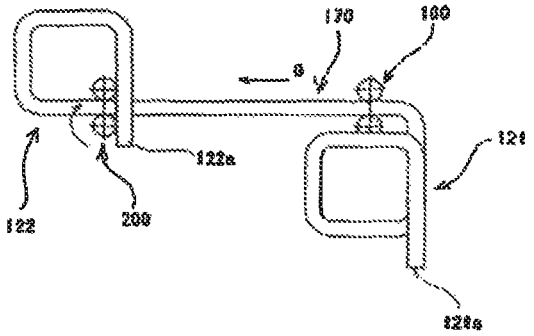

[FIG. 10A]
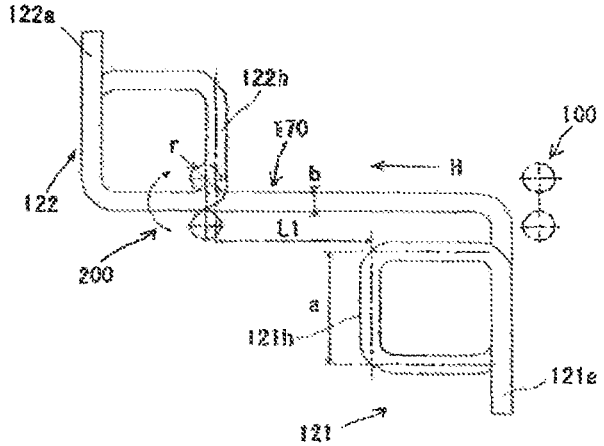
[FIG. 10B]
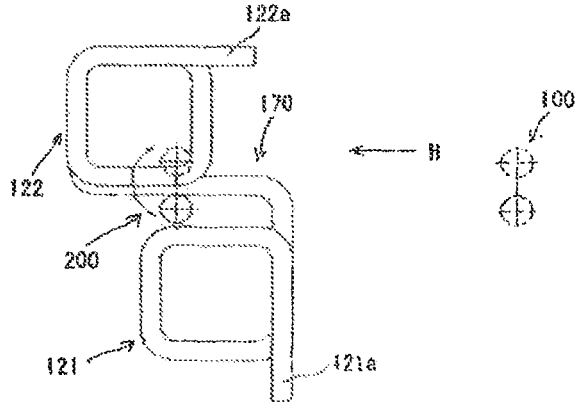
[FIG. 10C]
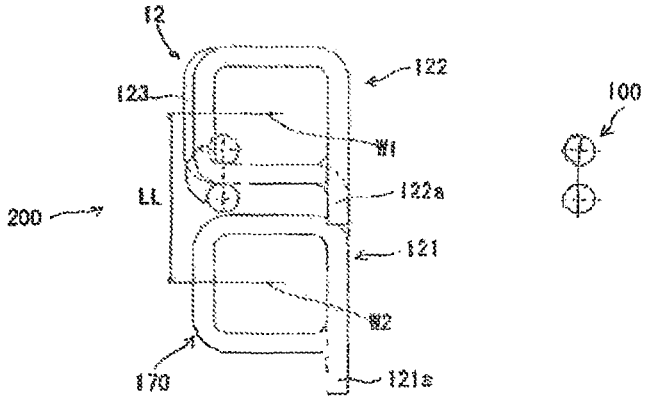

COIL AND METHOD FOR FORMING A COIL

The present application is a Continuation Application of U.S. patent application Ser. No. 13/315,067, filed on Dec. 8, 2011, which is a Divisional Application of U.S. patent application Ser. No. 12/227,181, filed on Nov. 10, 2008, now U.S. Pat. No. 8,091,211 B2, issued on Jan. 10, 2012, which is based on International Patent Application No. PCT/JP2007/000507, filed on May 11, 2007, which is based on Japanese Patent Application No. 2006-133041, filed on May 11, 2006, and Japanese Patent Application No. 2007-018828, filed on Jan. 30, 2007, the entire contents of which are incorporated herein by reference.

BACKGROUND OF THE INVENTION

1. Technical Field

The present invention relates to a coil to be used as an electronic component and a method for forming the coil and more particularly to the coil suitably used as a coil of a reactor and the method for forming the coil.

2. Description of Related Art

In general, a reactor has, for example, a winding and a core made of a magnetic substance and the winding is wound around the core to make up the coil of the reactor, which enables inductance to be obtained. Conventionally, the reactor is used in a voltage boosting circuit, inverter circuit, active filter circuit, or the like, and, in many cases, such the reactor has a structure in which the core and the coil wound around the core are housed, together with other insulating members or the like in a case made of metal or the like (see, for example, Patent Reference 1).

For a reactor to be used in a vehicle-mounted voltage boosting circuit, a coil is used which has a structure in which two single-coil elements each having a predetermined winding diameter and the number of windings that can provide a high inductance value in a high current region are formed in parallel to each other and are coupled (connected) to each other so that the directions of currents flowing through both the coils are reversed to one another.

The first conventional example of such the coil has a structure in which each of the two single-coil elements described above is formed by individual winding and the two single-coil elements are connected to each other by performing welding on an end portion on the coupling side of the windings via communicating terminals (see, for example, Patent Reference 2).

The second conventional example of such the coil has a structure in which two single-coil elements placed in parallel to each other and wound in the same direction are formed by edgewise winding using one piece of rectangular wire rod and the resulting coil is housed within the outside shape formed by end surfaces of both the coil elements by folding, in half, the coupling portion of the rectangular wire rod lying between the above two single-coil elements connected to each other along a width direction orthogonal to a longitudinal direction (see, above Patent Reference 2).

Patent Reference 1: Japanese Patent Application Laid-open No. 2003-124039

Patent Reference 2: Japanese Patent No. 3737461

SUMMARY OF THE INVENTION

However, in the first conventional coil described above, the windings to form both the coil elements are coupled via the communicating terminal and, therefore, as described in the above Patent Reference 2, the communicating terminal and the end portion on the coupling side of each of the windings protrude outside from the external shape formed by end surfaces of both the coil elements, resulting in an increase in space occupied by the coil and, when the coil is to be housed in the case described above, in particular, the case becomes the larger in size, thus causing an entire reactor to become large in size.

Moreover, in the above first conventional example of the coil, processes are further required in which coatings on each of the windings and on the end portion on the coupling side of each of the windings are peeled for the connection of both the coil elements and the communicating terminal and, after that, welding is to be performed on these portions, as a result, causing the manufacturing steps of the coil to be very complicated. Furthermore, in the above first conventional example, the two coil elements each being made up of the individual winding are connected electrically to each other by performing the welding via the communicating terminal and, therefore, it is unavoidable that reliability in the welded portions becomes a problem and still another problem arises that variations occur in electrical characteristics depending on how the welding is performed.

Incidentally, since approximately ring-like cores, for example, are inserted into the two coil elements making up a reactor, high accurate arrangement of the two coils is required. However, in the case of the first conventional example of the coil, the end portions on the coupling side of the two coil elements are coupled via the communicating terminal to each other and, therefore, variations occur readily in the arrangement of the two coil elements, which causes the insertion of the core to become impossible, in some cases.

On the other hand, in the second conventional coil described above, the two coil elements are formed by using the same winding and, therefore, the communicating terminal is not necessary, which makes it to easily house the coupling portion within the outside shape formed by end surfaces of both the coil elements. However, the coupling portion is formed on the end portion side of both the coil elements in a manner in which the coupling portions is folded in half and, as a result, the folded portion unavoidably protrudes on the end portion side of both the coil elements, thus causing an increase in space occupied by the coil in a manner to correspond to the folded portion. In this case, there is a fear that, if thickness of the folded portion is made to be reduced, electrical characteristics of the winding, that is, of the coil are affected by curvature of the folded portion being made very small. Also, it cannot be denied that there is a possibility that variations occur in electrical characteristics depending on how the coupling portion is folded. Furthermore, though the process of performing the welding between both the coil elements and the communicating terminal is made unnecessary, the above-described additional step of folding the coupling portion is required, which presents another problem that the manufacturing processes become complicated.

The first object of the present invention is to provide technology capable of reducing the space occupied by a coil serving as a component of a reactor as much as possible to achieve further miniaturization of the reactor.

The second object of the present invention is to provide technology for a coil made up of complicated coil elements which is capable of eliminating variations in characteristics of the coil and providing high reliability by negating the need for processes of performing welding and folding of coupling portions among the coil elements.

The third object of the present invention is to provide technology for a coil made up of the coil elements which is capable of simplifying processes of manufacturing the coil by negating the need for processes of performing welding and folding of coupling portions among the coil elements.

The fourth object of the present invention is to provide technology for a coil made up of the coil elements which is capable of reliably inserting a core into each of the coil elements by making the accuracy of arrangement of a plurality of coil elements be high.

The inventor of the present invention has found a coil and a method for forming the coil having a new configuration in which a plurality of coil elements is formed so that the plurality of coil elements are disposed on the same side in order to negate the need for folding-back of a coupling portion and so that directions of currents flowing through the plurality of coil elements are reversed.

That is, to achieve the above first to third objects, a coil of the present invention is formed by edgewise and rectangular winding of one piece of rectangular wire rod in a manner in which the wound rectangular wire rod is stacked rectangularly and cylindrically in a manner in which, at least, a first coil element and a second coil element are aligned in parallel to each other in a continuous state and winding directions of the rectangular wire rod are reversed to each other, which is characterized in that, at a winding terminating end point of the first coil element formed by edgewise and rectangular winding of the rectangular wire rod in a manner in which the wound rectangular wire rod is stacked rectangularly and cylindrically, the rectangular wire rod is bent approximately 90 degrees in a direction opposite to the winding direction of the first coil element so that the rectangular wire rod is stacked in a direction opposite to the stacking direction of the first coil element and is wound edgewisely and rectangularly in a direction opposite to the winding direction of the first coil element to form a second coil element and, at a winding terminating end point of the second coil element, the first coil element and second coil element are arranged in parallel to each other in a continuous state.

By configuring as above, a welding portion to couple coil elements to one another and a folding portion are not required and, therefore, space occupied by a coil as a component is reduced as much as possible, which enables further miniaturization of a reactor or the like to be realized. Also, welding to couple the coil elements to one another and/or folding-back to align the coil elements in parallel are not required and, therefore, the coil being free of variations in characteristics and having high reliability can be obtained. Further, the needs for welding work and/or folding-back are negated and, therefore, the manufacturing work can be simplified.

To achieve the above first to third objects, there is provided a coil forming method of the present invention for forming the coil constructed by edgewise and rectangular winding of one piece of rectangular wire rod in a manner in which the wound rectangular wire rod is stacked rectangularly and cylindrically and, at least, a first coil element and a second coil element are aligned in parallel to each other in a continuous state and winding directions of the rectangular wire rod are reversed to each other, and for forming first and second coil elements from one piece of rectangular wire rod using a first winding head and a second winding head mounted apart by a predetermined interval from the first winding head, the method including:

a first rectangular wire rod feeding process of preparing a rectangular wire rod having a length required for winding to form the first coil element and second coil element and feeding the rectangular wire rod from the second winding head side to the first winding head side to set the rectangular wire rod to the first winding head and to set an end portion of the rectangular wire rod to a state of protruding from the first winding head by a predetermined length;

a first coil element winding process of winding the rectangular wire rod by using the first winding head until the number of windings of the first coil element reaches a specified value to form the first coil element;

a second rectangular wire rod feeding process of feeding the rectangular wire rod at an end of which the first coil element is formed again from the second winding head side to the first winding head side;

a first coil element forming process of setting the first coil element to a state of having a specified posture by bending the entire first coil element approximately 90 degrees;

a third rectangular wire rod feeding process of feeding the rectangular wire rod from the second winding head side further to the first winding head to ensure a winding portion for the second coil element; and a second coil element winding process of winding the rectangular wire rod by using the second winding head until the number of windings of the first coil element reaches a specified value to form the second coil element.

By configuring as above, the method for forming the coil can be obtained by which the need for the welding to couple the coil elements to each other and folding-back is negated and, therefore, the space occupied by the coil as a component can be reduced as much as possible, which enables the miniaturization of the reactor or the like and welding to couple the coil elements to one another and/or folding-back to align the coil elements in parallel are not required and, therefore, the coil forming method being free of variations in characteristics and having high reliability can be realized. Further, the needs for welding work and/or folding-back are negated and, therefore, the manufacturing work can be simplified.

Also, in the second rectangular wire rod feeding process, the rectangular wire rod is fed excessively by a coil interval length in order to ensure an interval between the first coil element and the second coil element.

By configuring as above, a predetermined coil interval length between the first coil element and second coil element can be readily ensured in advance and, therefore, variations in the coil element between the first coil element and second coil element can be eliminated, which can enhance the reliability of the formed coil. Also, the third rectangular wire rod feeding process may include a process of cutting the rectangular wire rod to push the rectangular wire rod out by a predetermined length for cutting so that an end of the rectangular wire rod formed by the cutting makes up an end portion of the second coil element.

By configuring as above, the winding of the second coil element is made easy, whereby the manufacturing work can be simplified.

On the other hand, to achieve the first to fourth objects, there is provided a coil having, at least, a first coil element formed by edgewise and rectangular winding of the rectangular wire rod in a manner in which the wound rectangular wire rod is stacked rectangularly and cylindrically and a second coil element formed by edgewise and rectangular winding of the rectangular wire rod in a direction opposite to a stacking direction of the first coil element in a manner in which the rectangular wire rod is stacked in a direction opposite to the stacking direction of the first coil element at a winding terminating end point of the first coil element, which is characterized in that the first coil element and the second coil element are formed in parallel to each other in a continuous manner at a winding terminating point of the second coil element by performing offset winding using the rectangular wire rod based on an offset amount obtained by measuring a positional relation between the second coil element and the first coil element.

By configuring as above, the accumulation of wire rod feeding errors occurring when each side of the second coil element during the winding process by offset winding can be cancelled and, therefore, the arrangement of the first and second coil elements can be made high accurate and the approximately ring-like core can be reliably inserted in each of the first and second coil elements. Moreover, a welding portion to couple coil elements to one another and a folding portion are not required and, therefore, the coil being free of variations in characteristics and having high reliability can be obtained. Further, the needs for welding work and/or folding-back are negated and, therefore, the manufacturing work can be simplified.

Also, to achieve the first to fourth objects, there is a coil forming method for forming the coil constructed by edge-wise and rectangular winding of one piece of rectangular wire rod in a manner in which the wound rectangular wire rod is stacked rectangularly and cylindrically and, at least, a first coil element and a second coil element are aligned in parallel to each other in a continuous state and winding directions of the rectangular wire rod are reversed to each other and for forming first and second coil elements from the one piece of rectangular wire rod using a first winding head and a second winding head mounted apart by a predetermined interval from the first winding head, the method including:

a first rectangular wire rod feeding process of preparing a rectangular wire rod having a length required for winding to form the first coil element and second coil element and feeding the rectangular wire rod from the second winding head side to the first winding head side to set the rectangular wire rod to the first winding head and an end portion of the rectangular wire rod to a state of protruding from the first winding head by a predetermined length;

a first coil element winding process of winding the rectangular wire rod by using the first winding head until the number of windings of the first coil element reaches a specified value to form the first coil element;

a second rectangular wire rod feeding process of feeding the rectangular wire rod at an end of which the first coil element is formed again from the second winding head side to the first winding head side;

a first coil element forming process of setting the first coil element to a state of having a specified posture by bending the entire first coil element;

a third rectangular wire rod feeding process of feeding the rectangular wire rod further from the winding head side to the first winding head side in order to ensure a winding portion for the second coil element; and a second coil element winding process of winding the rectangular wire rod until the number of windings of the second coil element reaches a predetermined value by using the second winding head and calculating an offset amount by measuring a positional relation between the second coil element and the first coil element during the winding process and forming the second coil element by performing offset winding based on the obtained offset amount.

By configuring as above, the accumulation of wire rod feeding errors occurring when each side of the second coil element during the winding process by offset winding can be cancelled and, therefore, the arrangement of the first and second coil elements can be made high accurate and the approximately ring-like core can be reliably inserted in each of the first and second coil elements. Moreover, a welding portion to couple coil elements to one another and a folding portion are not required and, therefore, the coil being free of variations in characteristics and having high reliability can be obtained. Further, the needs for welding work and/or folding-back are negated and, therefore, the manufacturing work can be simplified.

Also, in the second rectangular wire rod feeding process, the rectangular wire rod is fed excessively by a coil interval length in order to ensure an interval between the coil element and the second coil element.

By configuring as above, a predetermined coil interval length between the first coil element and second coil element can be readily ensured in advance and, therefore, variations in the coil element between the first coil element and second coil element can be eliminated, which can enhance the reliability of the formed coil.

In the coil element winding process, the offset amount is obtained to ensure a distance between an axis core of the first coil element and an axis core of the second coil element as a specified length.

By configuring as above, variations in a distance between the axis core of the first coil element and the axis core of the second coil element can be eliminated, whereby, for example, the approximately ring-like core can be reliably inserted in each of the coil elements and thus reliability can be further enhanced.

According to the present invention, no protrusion of the communicating terminal and the end portion on the coupling side of each of the windings outside from the external shape formed by end surfaces of both the coil elements occurs and no increase occurs in space occupied by the coil. Moreover, the folding-back portion for coupling is not required, which can prevent the protrusion of members or the like toward the end surface side of both the coil elements and can reduce the space occupied by the coil and, therefore, when the coil of the present invention is applied to electronic components or the like in which the coil is housed in a case, it is made possible to make the case small in size, thus achieving the miniaturization of the entire electronic component.

Further, no welding portion presents a problem in terms of reliability and there is no possibility that variations occur in electrical characteristics of a coil depending on how the coil is folded back, whereby the coil with high reliability and safety in electrical characteristics can be formed.

Also, processes of welding between both the coil elements and the communicating terminal and of folding-back are not required, thereby simplifying the manufacturing work of the coil.

Furthermore, offset winding is performed based on offset amounts calculated by measuring a positional relation between the second coil element and first coil element during the winding process and, therefore, the accumulation of wire rod feeding errors occurring while each side of the second coil element is formed during the winding process can be cancelled and the arrangement of the first coil element and second coil element can be made highly accurate. This enables, for example, the approximately ling-like core to be reliably inserted in each of the coil elements, thereby providing the coil having high reliability and safety in electrical characteristic.

BRIEF DESCRIPTION OF DRAWINGS

FIG. 1 is a perspective view of one example of a reactor having a coil according to an embodiment of the present invention;

FIG. 2 is an exploded perspective view of the reactor of FIG. 1;

FIG. 3 is a perspective view of the reactor coil to the first embodiment of the present invention;

FIGS. 4A-4D are the first diagrams explaining a method of forming the reactor coil according to the first embodiment of the present invention;

FIGS. 5A-5C are the second diagrams explaining a method of forming the reactor coil according to the first embodiment of the present invention;

FIGS. 6A-6B are the third diagrams explaining a method of forming the reactor coil according to the first embodiment of the present invention;

FIG. 7 is a perspective view of a reactor coil according to the second embodiment of the present invention;

FIGS. 8A-8D are the first diagrams explaining a method of forming the reactor coil according to the second embodiment of the present invention;

FIGS. 9A-9C are the second diagrams explaining a method of forming the reactor coil according to the second embodiment of the present invention; and FIGS. 10A-10C are the third diagrams explaining a method of forming the reactor coil according to the second embodiment of the present invention.

DETAILED DESCRIPTION OF THE INVENTION

A coil of the first embodiment of the present invention is described in detail by referring to drawings. According to the first embodiment, the coil of the present invention is applied to a coil of a reactor (hereinafter, referred to as a reactor coil). FIG. 1 is a perspective view of a reactor as one example including the reactor coil of the present invention. The reactor 10 shown in FIG. 1 is used for an electrical circuit in a device having, for example, a forcedly cooling means and is configured so that, after a reactor coil 12 formed by winding one rectangular wire 17 around the reactor core 9 with a bobbin (not shown in FIG. 1) being interposed between the rectangular wire 17, and the reactor coil 12 is housed in a thermal conductive case 1, a filler 8 is poured therein so as to secure the reactor coil 12. Also, as is described later by referring to FIG. 3, the reactor coil 12 of the first embodiment includes the first coil element 121 and second coil element 122 each formed by edgewise and rectangular winding of the rectangular wire 17 in a manner in which the wound rectangular wire 17 is stacked rectangularly and cylindrically. Moreover, in the lead portions 121L and 122L respectively forming an end portion of the first coil elements 121 and 122, a coating is peeled off the rectangular wire 17 and a conductor of the rectangular wire 17 is stripped off and a pressure connection terminal (not shown) and the like are mounted to be electrically connected to other electrical components. The reactor securing holes 13 formed at four corners of the thermal conductive case 1 are used each as a screw hole to secure the reactor coil 12 to, for example, a forcedly cooled case or the like.

FIG. 2 is an exploded perspective view of the reactor 10 shown in FIG. 1. The reactor 10 includes the thermal conductive case 1, an insulation/dissipation sheet 7, the reactor coil 12, the bobbin 4, and the reactor core 9. The reactor coil 12 is formed by winding the rectangular wire 17 around the bobbin 4. The bobbin 4 is made up of a partitioning portion 4*a* and a winding frame portion 4*b* and is so configured that the partitioning portion 4*a* can be separated from the winding frame portion 4*b* from the viewpoint of improvement of working efficiency.

Next, after the reactor coil 12 is formed in the winding portion 4*b*, the partitioning portion 4*a* is fitted from both ends of the winding frame portion 4*b*. Then, the reactor cores 9 are inserted into the winding frame portion 4*b*. The reactor core 9 is made up of a plurality of blocks 3*a* and 3*b* each made of a magnetic substance and sheet members 6 to be inserted as a magnetic gap among the blocks 3*b*. In the embodiment, the reactor core 9 is made up of two pieces of blocks 3*a*, 6 pieces of blocks 3*b* and 8 pieces of sheet members 6. Each of the reactor cores 9 has an approximately ring-like shape and the blocks 3*b* each made of the magnetic substance and the sheet members 6, all of which form a straight-line portion, is inserted into the winding frame portion 4*b*. The reactor core 9 have two straight-line portions and the reactor coil 12 is formed in each of the straight-line portions with the winding frame portion 4*b* being interposed therein to obtain a specified electrical characteristic. The blocks 3*a* made of the magnetic substance are connected to each of the straight-line portions, as a result, forming the reactor core 9 having the approximately ring-like shape. Moreover, after the blocks 3*b* made of the magnetic substance and the sheet members 4 are inserted into the winding frame portion 4*b* of the bobbin 4, the blocks 3*a* are bonded to the sheet members 6 and, therefore, the blocks 3*a* are so configured as not to be separated.

By the above procedures, the reactor cores 9 and reactor coils 12 are formed. After that, after the insulation/dissipation sheet 7 is placed on the bottom face of the thermal conductive case 1, the reactor core 9 and reactor coil 12 are housed in the thermal conductive case 1. Next, the filler 8 is poured into the thermal conductive case 1 to secure the reactor cores 9 and reactor coil 12 in the thermal conductive case 1. The insulation/dissipation sheet 7 is placed between the reactor coil 12 and thermal conductive case 1 to provide insulation of both. Moreover, the insulation/dissipation sheet 7 of the embodiment uses the sheet having thermal conductivity being higher than that of the surrounding filler 8 and, therefore, can transfer heat generated from the reactor coil 12 to the thermal conductive case 1 effectively. By this, the heat generated from the reactor coil 12 is dissipated efficiently from the forcedly cooled thermal conductive case 1.

As described above, the reactor coil 12 of the embodiment includes the first coil element 121 and second coil element 122 each formed by edgewise and rectangular winding of the rectangular wire 17 in a manner in which the wound rectangular wire 17 is stacked rectangularly and cylindrically. Owing to this, the first coil element 121 and second coil element 122 are so formed that the bottom faces are plane and are in contact with the thermal conductive case 1 with the insulation/dissipation sheet 7 interposed therebetween and, therefore, the reactor coil 12 is excellent in a dissipation characteristic compared with the case where coil elements are stacked in layer in a cylindrical manner. Also, similarly, when compared with the case where coil elements are stacked in layer in a cylindrical manner, dead space in the thermal conductive case 1 is reduced, thus enabling the reactor coil 12 to be housed in a case with reduced volume, which serves to make an entire of the reactor be small in size. Further, the reactor coil 12 of the embodiment has the first coil element 121 and second coil element 122 formed by winding the rectangular wire 17 edgewisely (vertically) and, therefore, a voltage among wires can be made smaller compared with the case where the rectangular wire 17 is wound in a horizontal manner. Accordingly, even in the reactor coil to which a large voltage of 1000 volts is applied, it is possible to ensure high reliability.

FIG. 3 is a perspective view showing the reactor coil 12 of the embodiment. As shown in FIG. 3, the reactor coil 12 of the embodiment is made up of the first coil element 121 and second coil element 122 each formed by edgewise and rectangular winding of one piece of rectangular wire 17 in a manner in which the wound rectangular wire 17 is stacked rectangularly and cylindrically. The first coil element 121 and second coil element 122 are formed so as to be in parallel to each other in a continuous manner and so that the winding directions thereof are reversed to each other. The reactor coil 12 is characterized in that, in a winding terminating end portion 121E of the first coil element 121 formed by edgewise and rectangular winding of the rectangular wire 17 in a manner in which the wound rectangular wire 17 is stacked rectangularly and cylindrically, the rectangular wire 17 is bent approximately 90 degrees in a direction opposite to the winding direction of the first coil element 121 so that the rectangular wire 17 is stacked in a direction (shown by the arrow B in FIG. 3) opposite to the stacking direction (shown by the arrow A in FIG. 3) of the first coil element and is wound edgewisely and rectangularly in a direction opposite to the winding direction of the first coil element 121 and, as a result, in a winding terminating end portion of the second coil element 122, the first coil element 121 and second coil element 122 are arranged in parallel to each other in a continuous manner. Here, the term "edgewise winding" denotes a winding way by which the rectangular wire 17 is wound vertically. Also, the term "rectangular winding" denotes a winding way by which a coil is wound rectangularly, which is put in contract with the term "roundly winding". Moreover, the lead portion 121L of the coil element 121 and the lead portion 122L of the coil element 122 is placed on the same side of each of the coil elements 121 and 122 and, therefore, even when unillustrated terminals are mounted to an edge portion of each of the lead portion 121L and 122L, it is possible to align the terminals.

Incidentally, the method for forming the reactor coil 12 of the embodiment is described by referring to FIGS. 4A-4D, 5A-5B, and 6A-6B. In the method for forming the reactor coil 12 of the embodiment, as shown in FIG. 4A to FIG. 6B, the winding is performed by using a winding head 100 for the first coil element and a winding head 200 for the second coil element. Each of the winding heads 100 and 200 has two head members each disposed in a manner to face each other with a predetermined interval. First, as shown in FIG. 4A, a rectangular wire being a wire rod (hereinafter, called a rectangular wire rod 170) is fed to a specified position (first process of feeding the rectangular wire rod 170). That is, as the winding to be used for the first coil element 121 and second coil element 122, the sufficiently long rectangular wire rod 170 is prepared and the rectangular wire rod 170 is then fed from the winding head 200 side to the winding head 100 side, that is, to the direction shown by the arrow A in FIG. 4A to let the rectangular wire rod 170 be drawn through the winding head 100 in order to set the position of the rectangular wire rod 170 so that the tip 170*f* of the rectangular wire rod 170 protrudes from the winding head 100 having a predetermined length. The rectangular wire rod 170 is formed by covering a so-called rectangular conductive line with a coating. Moreover, the tip 170*f* of the rectangular wire rod 170, as described later, makes up an end portion 121*a* of the first coil element 121.

Then, as shown in FIG. 4B, winding is performed to form the first coil element 121 by using the winding head 100 (winding process of the first coil element). In this case, winding is performed to form the first coil element 121 until the predetermined number of windings is reached (the same for the second coil element 122). The rectangular wire rod 170 is wound around the first coil element 122 toward a direction shown by the arrow B in FIG. 4B. As shown in FIG. 4B and later other drawings, the first coil element 121 (or second coil element 122) is formed so as to have a specified dimension in a direction orthogonal to paper in the drawing (in a lower direction or higher direction of paper in the drawing).

After the formation of the first coil element 121, as shown in FIG. 4C, the rectangular wire rod 170 is again fed (second feeding process of rectangular wire rod). That is, the tip 170*f* of the rectangular wire rod 170 is fed to a direction shown by the arrow C in FIG. 4C. At this time, in order to ensure an interval between the first coil element 121 and second coil element 122, the rectangular wire rod 170 is fed excessively by a predetermined coil interval length T.

As shown in FIG. 4D, the entire first coil element 121 is formed (bent) at 90 degrees. That is, by forming (bending) the rectangular wire rod 170 at 90 degrees in a direction shown by the arrow D in FIG. 4D, the first coil element 121 is set to take a predetermined posture. In this case, at the position where the rectangular wire rod 170 is protruded from the winding head 100 by the coil interval length T, the rectangular wire rod 170 is bent 90 degrees by using the winding head 100. That is, by bending the rectangular wire rod 170 at the position where the rectangular wire rod 170 is shifted by the specified coil interval length T by using the winding head 100 by 90 degrees, the entire first coil element 121 is formed.

Then, as shown in FIG. 5A, the rectangular wire rod 170 is further fed (third feeding process of the rectangular wire rod). The tip 170*f* of the rectangular wire rod 170 is further fed in a direction shown by the arrow E in FIG. 5A. The process is a big feature of the method of forming the reactor coil 12 of the embodiment and, in order to ensure the length of the wire rod required for the winding of the second coil element 122, the rectangular wire rod 170 is fed until the first coil element 121 and rectangular wire rod 170 are protruded from the winding head 100 over a considerable length. Moreover, according to the embodiment, the rectangular wire rod 170 is cut after the rectangular wire rod 170 is pushed out from the supplying source thereof by a sufficient length and the end 170*b* of the rectangular wire rod 170 formed by the cutting makes up the tip wire rod 170 formed by the cutting makes up the tip 122*a* of the second coil element 2.

Next, as shown in FIG. 5B, winding is performed to form the second coil element 122 by using the winding head 200 (winding process of second coil element). In this case, the winding is performed to form the second coil element 122 until the predetermined number of windings is reached (the same for the first coil element 121). At this time point, as shown in FIG. 5B, by forming the rectangular wire rod 170 in a direction opposite to the first coil element 121 by using the winding head 200, the winding to form the second coil element 122 is performed. That is, by forming (bending) the rectangular wire rod 170 at 90 degrees in a direction shown by the arrow F in FIG. 5B, the winding to form the second coil element 122 is started. Accordingly, the winding to form the second coil element 122 is performed by using a portion existing between the winding head 200 and winding head 100 of the rectangular wire rod 170 as shown in FIG. 5B and a portion pushed out from the winding head 100 as shown in FIG. 5A. That is, when the rectangular wire rod 170 is formed (bent) 90 degrees, the bending direction of the rectangular wire rod 170 is changed (bending direction is reversed 180 degrees).

Thus, as shown in FIGS. 5A and 5B, after the completion of the winding to form the first coil element 121, the rectangular wire rod 170 is fed by the length required for winding to form the second coil element 122 and then the rectangular wire rod 170 is rewound in a reverse direction to perform the winding to form the second coil element 122. This method of forming the reactor coil is a big feature of the present embodiment.

Thus, as shown in FIG. 5C, due to the winding to form the second coil element 122, the first coil element 121 is moved to the winding head 200 side, that is, in a direction shown by the arrow G in FIG. 5C. That is, this means that the coil elements 121 and 122 begin to come near to each other.

Further, as shown in FIG. 6A, the winding to form the second coil element 122 proceeds and, as a result, the coil elements 121 and 122 come nearer to each other. At this time, as shown in FIG. 6A, the first coil element 121 is separated from the winding head 100 and comes near to the second coil element 122 in a direction shown by the arrow H in FIG. 6A. Therefore, it is desirable that the reactor coil 12 has a mechanism of lifting the first coil element 121 so that the first coil element is separated from the winding head 100 upward.

As shown in FIG. 6B, the winding proceeds from the state of the second coil element 122 shown in FIG. 6A further to the state of the winding by a quarter round (90 degrees), thereby completing the formation of the second coil element 122, and thus making the winding of both the coil elements 121 and 122 be completed, which finishes the formation of the reactor coil 12. In this state where the winding has been completed, the end portion 121*a* (tip 170*f* of the rectangular wire rod 170) of the first coil element and the end portion 122*a* (end portion 170*b* of the rectangular wire rod 170) of the second coil element are aligned in an extended manner in the same direction as shown in FIG. 6B. Moreover, it is necessary that the completed reactor coil 12 made up of both the coil elements 121 and 122 is separated from the winding head 200 and, therefore, it is desirous that the mechanism of lifting both the coil elements 121 and 122 so that the coil elements 121 and 122 are removed upward is provided.

By using the above forming method, as shown in FIG. 3, the reactor coil 12 having no rewound portion can be obtained. That is, according to the method of forming the reactor coil of the embodiment, the posture of each of completed coil elements 121 and 122 is in the state as shown in FIG. 3 and, therefore, the processes of welding (coupling) both the coil elements 121 and 122 and rewinding the rectangular wire rod 170 can be omitted. Unlike in the case of the conventional first example of the coil where the winding is performed individually to form each of the coil elements and both the coil elements are coupled by welding, in the present embodiment, both the coil elements 121 and 122 are wound by the rectangular wire rod 170 continuously on both sides, whereby members and the number of man-hours for coupling are not required. In the conventional second example of the coil, the members and the number of man-hours for coupling are not required, however, in the case of the conventional second example, rewinding is required which causes the completed coil to have a rewound portion and which requires the process of rewinding. According to the reactor coil and its forming method of the present embodiment, as in the case of winding (rectangular winding) of an ordinary reactor coil, bending by approximately 90 degrees is simply required and the completed coil has no rewound portion, thereby making the rewinding process unnecessary. That is, the term "rewinding" denotes warping the rectangular wire rod, as a whole, about 180 degrees as in the conventional second case, while the term "bending" denotes warping the rectangular wire rod about 90 degrees as in the case of winding (rectangular winding) of an ordinary reactor coil. In other words, in the conventional second example of the coil, the coupling portion of the rectangular wire rod lying between both the coil elements connected to each other is folded in half along the width direction orthogonal to the longitudinal direction of the rectangular wire rod, however, according to the present embodiment, the rectangular wire rod 170 is bent about 90 degrees in a shifting portion from the first coil element 121 to the second coil element 122 in a direction opposite to the winding direction of the first coil element. That is, the shifting portion of the rectangular wire rod 170 from the first coil element 121 to the second coil element 122 is bent about 90 degrees along a thickness direction of the rectangular wire rod 170.

Thus, the reactor coil and the method for forming the reactor coil of the present embodiment is characterized by the way of coupling between both the coil elements 121 and 122. In the conventional first example of the coil, it is necessary that the member and area such as the communicating terminal and welding portion not serving as the winding portion of the coil are provided which are used only for coupling between both the coil elements. Also, in the second conventional example of the coil, it is necessary that an area for rewinding is provided which is used only for coupling between both the coil elements not serving as the winding portion. Unlike the first and second conventional examples, according to the reactor and method for forming the coil of the present embodiment, as shown in FIG. 3, the winding portion of the first coil element 121 is bent, as it is, 90 degrees to be coupled to the winding portion of the second coil element 122 and, therefore, there is no need of preparing any member or area to be used only for coupling, which can provide an epoch-making wasteless structure for the coil. In other words, all portions of the rectangular wire rod 170 except the bending portion serve as part of the first coil element 121 or part of the second coil element 122 (as part functioning as a coil to generate inductance).

As described above, the coil and method of forming the coil of the embodiment and the present invention is characterized in that the coupling between both the coil elements is made possible only by directly bending the rectangular wire rod 170 without using needless portions such the terminal for welding or folding-back portion for coupling. Therefore, unlike the first conventional example, the end portion on the coupling side including the communicating terminal does not protrude from the external shape formed by end surfaces of both the coil elements to the outside, which does not cause an increase in space occupied by the coil. Further, unlike the conventional second example of the coil, no folding-back portion for coupling is required and, therefore, as is apparent from FIG. 3, there are no members or the like that protrude on the end surfaces of both the coil elements. As a result, space occupied by the coil is reduced, by the folding-back portion, when compared with the case of the conventional second example of the coil and, therefore, when the coil is housed in the case of the above-described thermal conductive case, in particular, the case can be made small in size and the reactor can be miniaturized as a whole.

Moreover, unlike the conventional first example of the coil, in the present embodiment, no problem arises in reliability of the welding portion. Unlike the conventional second example of the coil, there is no possibility that variations occur in electric characteristics depending on how the coil is folded back. Accordingly, the coil having high reliability and stable electric characteristics can be formed. Moreover, there are large advantages in that processes of welding between both the coil elements and communicating terminal of folding-back the coil are not required, whereby simplifying the manufacturing work.

Next, the reactor coil of the second embodiment of the present invention is described in detail by referring to drawings. FIG. 7 is a perspective view of the reactor coil 12 of the second embodiment of the present invention. As shown in FIG. 7, as in the case of the first embodiment, the reactor coil of the second embodiment includes the first coil element 121 and second coil element 122 each formed by edgewise and rectangular winding using one piece of rectangular wire rod 170 in a manner in which the wound rectangular wire rod 170 is stacked rectangularly and cylindrically. The first coil element 121 and second coil element 122 are formed so as to be in parallel to each other in a continuous manner and so that the winding directions thereof are reversed to each other. The reactor coil 12 is characterized in that, at a winding terminating end point 121E of the first coil element 121 formed by edgewise and rectangular winding using the rectangular wire rod 170 in a manner in which the wound rectangular wire rod 170 is stacked rectangularly and cylindrically, the rectangular wire rod 170 is bent approximately 90 degrees in a direction opposite to the winding direction of the first coil element 121 so that the rectangular wire rod 170 is stacked in a direction (shown by the arrow A in FIG. 7) opposite to the stacking direction (shown by the arrow B in FIG. 7) of the first coil element and is wound edgewisely and rectangularly in a direction opposite to the winding direction of the first coil element 121 and, as a result, at a winding terminating end point of the second coil element 122, the first coil element 121 and second coil element 122 are arranged in parallel to each other in a continuous manner.

Thus, the reactor coil 12 of the second embodiment is a two-gang connected coil formed by feeding, in advance, after the termination of the rectangular winding to form the first coil element 121, the rectangular wire rod 170 having a length required to perform winding to form the second coil element 122 and by winding to form the second coil element 122 rectangularly using the wire rod on the side where the first coil element 121 does not exist. As a result, there is a fear that the accumulation of wire rod feeding errors occurring when each side is formed during the process of rectangular winding to form the second coil element 122 appears as a variation in distance between the axis core of the first coil element 121 and the axis core of the second coil element 122. As described above, two straight-line portions making up the ring-like reactor core 9 are inserted into the first coil element 121 and second coil element 122 and, therefore, high dimensional accuracy is required in the distance between the axis core of the first coil element 121 and the axis core of the second coil element 122. According to the second embodiment, in order to cancel the accumulation of the wire rod feeding errors, offset winding is performed on an offset portion 123, as an excessive length portion, on the second coil element 122 existing near to the coupling portion between the first coil element 121 and second coil element 122.

Since the accumulation of wire rod feeding errors occurring when each side is formed during the process of winding to form the second coil element 122 can be cancelled by the offset winding, it is made possible to arrange the first coil element 121 and second coil elements 122 highly accurately and the two straight-portions making up the approximately ring-like reactor core 9 can be reliably inserted into each of the first and second coil elements 121 and 122. Further, welding to couple the coil elements 121 and 122 to each other and folding-back to align the first and second coil elements 121 and 122 in parallel to each other are not required and, therefore, the coil having no variations in characteristics and providing high reliability can be obtained. Moreover, the welding work and/or folding-back work are not required, thereby simplifying the manufacturing processes.

FIGS. 8A-8D, 9A-9B, and 10A-10C are diagrams showing the method for forming the reactor coil 12. In the method of forming the reactor coil 12, as shown in FIG. 8A to FIG. 10B, winding is performed by using the winding head 100 to form the first coil element 121 and the winding head 200 to form the second coil element 122. Each of the winding heads 100 and 200 includes two pulley-like head members disposed in a manner to face each other with a specified interval.

First, as shown in FIG. 8A, the rectangular wire rod 170 serving as a wire rod is fed up to a predetermined position (first process of feeding the rectangular wire rod). That is, as the winding to form the first coil element 121 and second coil element 122, the sufficiently long rectangular wire rod 170 is prepared and the rectangular wire rod 170 is then fed from the winding head 200 side to the winding head 100 side, that is, to the direction shown by the arrow A in FIG. 8A to let the rectangular wire rod 170 be drawn through the winding head 100 in order to set the position of the rectangular wire rod 170 so that the tip 170*f* of the rectangular wire rod 170 protrudes from the winding head 100 having a predetermined length. The rectangular wire rod 170 is formed by covering a so-called rectangular conductive line with a coating. Moreover, the tip 170*f* of the rectangular wire rod 170, as described later, makes up an end portion 121*a* of the first coil element 121.

Then, as shown in FIG. 8B, winding is performed to form the first coil element 121 by using the winding head 100 (winding process of the first coil element). In this case, winding is performed continuously to form the first coil element 121 until the predetermined number of windings is reached. The rectangular wire rod 170 is wound around the first coil element 122 toward a direction shown by the arrow B in FIG. 8 (*b*) to form the first coil element 121. As shown in FIG. 8B and later other drawings, the first coil element 121 is formed so as to have a specified dimension in a direction orthogonal to paper in the drawing (in a lower direction or higher direction of the paper in the drawing).

After the formation of the first coil element 121, as shown in FIG. 8C, the rectangular wire rod 170 is again fed (second feeding process of rectangular wire rod). That is, the tip 170*f* of the rectangular wire rod 170 is fed to a direction shown by the arrow C in FIG. 8C. At this time, in order to ensure an interval between the first coil element 121 and second coil element 122, the rectangular wire rod 170 is fed excessively by a predetermined coil interval length T shown in FIG. 8D described later.

As shown in FIG. 8D, the entire first coil element 121 is formed (bent) 90 degrees. That is, by forming (bending) the rectangular wire rod 170 by 90 degrees in a direction shown by the arrow D in FIG. 8D, the first coil element 121 is set so as to take a predetermined posture. In this case, at the position where the rectangular wire rod 170 is protruded from the winding head 100 by the coil interval length T, the rectangular wire rod 170 is bent 90 degrees by using the winding head 100. That is, by bending the rectangular wire rod 170 at the position where the rectangular wire rod 170 is shifted by the specified coil interval length T by using the winding head 100 by 90 degrees, the entire first coil element 121 is formed.

Then, as shown in FIG. 9A, the rectangular wire rod 170 is further fed (third feeding process of the rectangular wire rod). The tip 170*f* of the rectangular wire rod 170 is further fed in a direction shown by the arrow E in FIG. 9A. The process is a big feature of the method of forming the reactor coil 12 of the embodiment and, in order to ensure the length of the wire rod required for the winding to form the second coil element 122, the rectangular wire rod 170 is fed until the first coil element 121 and rectangular wire rod 170 are protruded from the winding head 100 over a considerable length. Moreover, according to the embodiment, the rectangular wire rod 170 is cut after the rectangular wire rod 170 is pushed out from its supplying source by a sufficient length and the end 170*b* of the rectangular wire rod 170 formed by the cutting process makes up the tip wire rod 170 formed by the cutting makes up the tip 122*a* of the second coil element 122.

Next, as shown in FIG. 9B, winding is performed to form the second coil element 122 by using the winding head 200 (winding process to form the second coil element). At this time point, as shown in FIG. 9B, by winding the rectangular wire rod 170 in a direction opposite to the first coil element 121 using the winding head 200, the winding is performed to form the second coil element 122. That is, by winding the rectangular wire rod 170 in a direction shown by the arrow F in FIG. 9B, the winding to form the second coil element 122 is started. Accordingly, the winding to form the second coil element 122 is performed by using a portion existing between the winding head 200 and winding head 100 of the rectangular wire rod 170 as shown in FIG. 9B and a portion pushed out from the winding head 100 as shown in FIG. 9A.

Thus, as shown in FIGS. 9A and 9B, after the completion of the winding to form the first coil element 121, the rectangular wire rod 170 is fed by the length required for winding to form the second coil element 122 and then the rectangular wire rod 170 is rewound in a reverse direction to perform the winding to form the second coil element 122. This method of forming the reactor coil is a big feature of the present embodiment. Thus, as shown in FIG. 9C, due to the winding to form the second coil element 122, the first coil element 121 is moved to the winding head 200 side, that is, in a direction shown by the arrow G in FIG. 9C. This means that the coil elements 121 and 122 begin to come near to each other.

Then, as shown in FIG. 10(A), when the winding to form the second coil element proceeds and the first coil element 121 and second coil element 122 come further near to each other, for example, when the winding is put into a state of being 2 turns (two times winding) before the completion of the winding, the distance between the first and second coil elements 121 and 122 is measured by a sensor and the measured data is stored in memory of the control section. The distance between both the coil elements 121 and 122 may be a definable distance between both the coil elements 121 and 122 shown in FIG. 10A including, for example, the distance L1 between a center of a side 121*h* of the first coil element 121 and a center of a side 122*h* of the second coil element 122 both facing each other, a distance between the axis core of the first coil element 121 and the axis core of the second coil element 122, or the like. Moreover, as the sensor to be used in the above measurement, any sensor may be used so long as it can measure a distance including an existing sensor, for example, an optical sensor, mechanical sensor or the like and, further, the measured value may be input into the control section of a winding machine or the like after visual measuring.

Then, an offset amount F is computed based on the measured distance between both the coil elements 121 and 122 so that the distance LL between the axis core W1 of the first coil element 121 and the axis core W2 of the second coil element 122 of the reactor coil 12 having its final configuration shown in FIG. 10B becomes a predetermined length to feed the rectangular wire rod 170 in the wire rod feeding amount obtained by adding the computed offset amount to an ordinary wire rod feeding amount. Thus, by setting the distance LL between the axis core W1 of the first coil element 121 and axis core W2 of the second coil element 122 to have a predetermined length, the insertion of the two straight-line portions of the approximately ring-like reactor core 9 therein is made possible. The winding to form the second coil element 122 is continued until its state shown in FIG. 10A is changed to its state shown in FIG. 10 (*f*) resulting from further a quarter round (90 degrees) winding. The offset amount F can be calculated from the equation (1):

$$F=(L1-a)/2+(b+r) \quad (1)$$

where "L1" denotes a distance between a center of a side 121*h* of the first coil element 121 and a center of a side 122*h* of the second coil element 122 both facing each other, which are stored in the memory of the control section of the winding machine, "a" denotes a length (distance between centers of the rectangular wire rod 170) of a side 121*h* of the first coil element 121 stored, in advance, in the memory of the control section of the winding machine, "b" denotes a width of the rectangular wire rod 170, and "r" denotes a diameter of the winding head 200. Moreover, as shown in FIG. 10A, the first coil element 121 is separated from the winding head 100 and comes near up to the second coil element 122 in a direction shown by the arrow H in FIG. 10A. Therefore, it is desirous that a mechanism is provided which lifts the first coil element 121 so that the first coil element 121 is separated from the winding head 100 upward.

Then, as shown in FIG. 10B, by feeding the rectangular wire rod 170 in an ordinary wire rod feeding amount and performing winding to form the second coil element 122 until its state shown in FIG. 10B is changed to the state shown in FIG. 10C resulting from further a quarter round (90 degrees) winding, the formation of the second coil element 122 is completed and winding to form both the coil elements 121 and 122 is completed, thus resulting in the formation of the reactor coil 12 of the embodiment. the offset winding is performed on an offset portion 123, as an excessive length portion, on the second coil element 122 side existing near to the coupling portion between the first coil element 121 and second coil element 122 and, therefore, the accumulation of the wire rod feeding errors can be cancelled. Moreover, in terms of the accumulation of the wire rod feeding errors, though the best effects can be expected in the offset portion on the second coil element 122 side existing near the coupling portion between the first coil element 121 and second coil element 122, the portion in which the offset winding is performed is not limited to the above and any portion may be selected to form the first coil element 121 or the second coil element 122.

Further, in the state where the winding has been completed, the end portion 121*a* (tip 170*f* of the rectangular wire rod 170) of the first coil element 121 and the end portion 122*a* (end 170*b* of the rectangular wire rod 170) of the second coil element 122 are aligned in an extended manner in the same direction as shown in FIG. 10B. The separation of the reactor coil 12 made up of both the coil elements 121 and 122 from the winding head 220 is required and, therefore, it is desirous that a mechanism to separate both the coil elements 121 and 122 from the winding head 200 upward is provided.

According to the above forming method, as shown in FIG. 7, the reactor coil 12 can be obtained which has cancelled the accumulation of the wire rod feeding errors and has no folded-back portion. That is, in the method for forming the reactor coil 12 of the embodiment, the posture of each of the formed coil elements 121 and 122 is in the state shown in FIG. 7 and, therefore, two straight-line portions of the approximately ring-shaped reactor core 9 can be inserted into the coil elements 121 and 122, whereby allowing the process of welding (coupling) both the coil elements 121 and 122 and folding-back process to be omitted.

Thus, the forming method is characterized by the way of coupling which enables the high accurate arrangement of both the coil elements 121 and 122. In the conventional first example of the coil, the member or area only for the coupling which does not serve as the winding portion of coils such as the communicating terminal and/or welding portion are required. Also, in the conventional second example of the coil, the area only for the coupling which does not serve as the winding of the coil such as the folding-back portion is required. Unlike the conventional examples, in the reactor coil and method of forming the reactor coil of the embodiment, as shown in FIG. 7, the winding portion of the first coil element 121 is bent, as it is, 90 degrees to be coupled to the winding portion of the second coil element 122 and, therefore, there is no need of preparing any member or area to be used only for coupling, which can provide an epoch-making wasteless structure for the coil. In other words, all portions of the rectangular wire rod 170 except the bending portion serve as part of the first coil element 121 or part of the second coil element 122 (as part functioning as a coil to generate inductance).

It is apparent that the present invention is not limited to the above embodiments but may be changed and modified without departing from the scope and spirit of the invention.

The present invention can be widely applied not only to a coil of a reactor but also to coils of other electronic components such as a transformer and the like so long as the coil is formed, at least, by performing winding using the rectangular wire rod edgewisely and rectangularly to form coil elements in a manner in which the wound rectangular wire rod is stacked and the coil elements are aligned in parallel to each other and the winding directions of the coil elements are reversed to each other.

EXPLANATION OF LETTERS OR NUMERALS

1: Thermal conductive case; 4: Bobbin; 7: Insulation/dissipation sheet; 8: Filler; 10: Reactor, 12: Reactor coil; 13: Reactor securing hole; 17: Rectangular wire; 121L, 122L: Lead portion; 121: First coil element; 122: Second coil element; 123: Offset portion; 100: Winding head; 200: Winding head; 170: Rectangular wire rod.

What is claimed is:

1. A coil, comprising:

first and second coil elements both of which are formed by feeding one piece of a rectangular wire rod by a predetermined amount and winding rectangularly in an edgewise manner using winding heads, the first and second coil elements being wound in opposite directions from each other, wherein a winding terminating end point of the first coil element is bent approximately 90 degrees in a direction opposite to a winding direction of the first coil element, and is connected to a winding terminating end point of the second coil element in a same flat plane, wherein the second coil element includes an offset portion of the rectangular wire rod that is offset, in a plan view, from a side of the second coil element, wherein the offset portion is formed by feeding an offset amount F in addition to the predetermined amount at half around before finishing winding the second coil element, and then finishing winding the second coil element, and wherein the offset amount F is calculated from an equation (1), $$F=(L1-a)/2+(b+r) \quad (1)$$

wherein:

"L1" is a distance, in the plan view, between a centerline of a side of the first coil element and a centerline of the side of the second coil element facing each other at half around before finishing winding the second coil element;

"a" is a length of the side of the first coil element;

"b" is a width of the rectangular wire rod; and

"r" is a diameter of the winding heads.

2. A coil as claimed in claim 1, the coil being configured to be used in a reactor, wherein the coil is contained in a thermally conductive case which includes an inner surface containing the coil, the inner surface comprising substantially a plane surface.

3. A coil as claimed in claim 2, wherein an insulation sheet is placed between the reactor and the thermally conductive case.

4. A coil as claimed in claim 1, wherein the coil is contained in a thermally conductive case which includes an inner surface containing the coil, the inner surface comprising substantially a plane surface.

5. A coil as claimed in claim 4, wherein bottom faces of the first coil element and the second coil element are co-planes and are in contact with the thermally conductive case.

6. A reactor comprising the coil as claimed in claim 1, wherein the coil is contained in a thermally conductive case which includes an inner surface containing the coil, the inner surface comprising substantially a plane surface.

7. A reactor as claimed in claim 6, wherein an insulation sheet is placed between the reactor and the thermally conductive case.

8. A coil as claimed in claim 1, wherein the first coil element and the second coil element are aligned in parallel to each other continuously.

9. A coil as claimed in claim 8, wherein the winding direction of the first coil element is reversed from a winding direction of the second coil element.

10. A coil as claimed in claim 9, wherein the rectangular wire rod is stacked in a direction opposite to a stacking direction of the first coil element, and is wound in a direction opposite to the winding direction of the first coil element to form the second coil element.

11. A coil as claimed in claim 10, further comprising:

a lead portion of the first coil element and a lead portion of the second coil element, wherein the lead portion of the first coil element and the lead portion of the second coil element are placed on a same side of each of the coil elements.

12. A coil as claimed in claim 1, further comprising:

a lead portion of the first coil element and a lead portion of the second coil element, wherein the lead portion of the first coil element and the lead portion of the second coil element are placed on a same side of each of the coil elements.

13. A coil as claimed in claim 1, wherein a coupling between the first coil element and the second coil element is by directly bending the rectangular wire rod.

14. A coil as claimed in claim 1, wherein a coupling between the first coil element and the second coil element is only by bending the rectangular wire rod.

15. A coil as claimed in claim 1, wherein a same flat plane continuously extends from an upper surface of the second coil element to an upper surface of the first coil element.

* * * * *